US008578558B2

(12) United States Patent
Bonomie et al.

(10) Patent No.: US 8,578,558 B2
(45) Date of Patent: Nov. 12, 2013

(54) HINGE SUPPORT

(75) Inventors: Arturo J. Bonomie, Verona, WI (US); Michael G. Wisniewski, North East, PA (US); Shawn W. Fogel, Madison, WI (US)

(73) Assignee: Sub-Zero, Inc., Madison, WI (US)

( * ) Notice: Subject to any disclaimer, the term of this patent is extended or adjusted under 35 U.S.C. 154(b) by 146 days.

(21) Appl. No.: 13/403,722

(22) Filed: Feb. 23, 2012

(65) Prior Publication Data

US 2013/0219797 A1 Aug. 29, 2013

(51) Int. Cl.
*E05D 7/04* (2006.01)

(52) U.S. Cl.
USPC ..... 16/238; 16/245; 16/243

(58) Field of Classification Search
USPC ..... 16/245, 235, 238, 246, 236, 237, 387, 16/270–272, 105, 90; 312/326, 327, 321.5
See application file for complete search history.

(56) References Cited

U.S. PATENT DOCUMENTS

| | | | | | |
|---|---|---|---|---|---|
| 2,583,950 | A * | 1/1952 | Kirschner | 16/238 |
| 2,839,778 | A * | 6/1958 | Hutchinson et al. | 16/245 |
| 3,325,942 | A * | 6/1967 | Bejarano | 49/381 |
| 3,457,584 | A * | 7/1969 | Phelps | 16/290 |
| 3,626,548 | A * | 12/1971 | Grunert | 16/358 |
| 4,014,073 | A * | 3/1977 | Uehara | 16/105 |
| 4,142,272 | A * | 3/1979 | Oogami et al. | 16/245 |
| 4,411,045 | A * | 10/1983 | Rock et al. | 16/243 |
| 4,434,523 | A * | 3/1984 | Grass | 16/242 |
| 5,483,770 | A * | 1/1996 | Marinoni | 49/388 |
| 6,141,830 | A * | 11/2000 | Shimooka | 16/237 |
| 6,499,189 | B2 * | 12/2002 | Kondo et al. | 16/289 |
| 7,543,356 | B2 * | 6/2009 | Zetti | 16/288 |
| 7,748,080 | B2 * | 7/2010 | Hottmann | 16/72 |
| 7,987,558 | B2 * | 8/2011 | Beckmann et al. | 16/366 |
| 2007/0113377 | A1 * | 5/2007 | Brachert | 16/247 |
| 2010/0269291 | A1 * | 10/2010 | Haab et al. | 16/91 |
| 2011/0068671 | A1 * | 3/2011 | Vanini | 312/405 |
| 2011/0089801 | A1 * | 4/2011 | Bonomie et al. | 312/405 |
| 2012/0080911 | A1 * | 4/2012 | Brykalski et al. | 297/180.15 |

* cited by examiner

*Primary Examiner* — Chuck Mah
(74) *Attorney, Agent, or Firm* — Bell & Manning, LLC

(57) ABSTRACT

A hinge support includes a brace, a trestle, and a positioning device. The brace includes a base wall and a first side wall, a second side wall, and a positioning wall that extend from the base wall. The first side wall has a first sloped surface, and the second side wall has a second sloped surface. The trestle includes a top wall and a third side wall, a fourth side wall, and a support wall that extend from the top wall. The third side wall has a third sloped surface, and the fourth side wall has a fourth sloped surface. The positioning device is supported by the support wall and positioned to abut the positioning wall to mount the trestle to the brace. The third sloped surface slides along the first sloped surface and the fourth sloped surface slides along the second sloped surface under control of the positioning device.

20 Claims, 10 Drawing Sheets

HINGE SUPPORT

BACKGROUND

Doors of all kinds are mounted to hinges for opening and closing of the doors. For example, a refrigerator door may be mounted to a hinge, which is mounted to a body of a refrigerator to allow the door to rotate open and closed under control of the hinge. Manufacturing tolerances for the door, the cabinet, and the hinge can result in a tolerance stack-up that can create a gap between a door hinge bracket and the door. As a result, the hinge may not be mounted level relative to the mounting surface of the door and/or the hinge may not be properly supported to approximately equally distribute the forces on the hinge.

SUMMARY

In an example embodiment, a hinge support is provided. The hinge support may include a brace, a trestle, and a positioning device. The brace is mounted to a surface of a door and comprises a base wall, a first side wall, a second side wall, and a positioning wall. The first side wall, the second side wall, and the positioning wall extend from the base wall in a first direction. The first side wall has a first sloped surface, and the second side wall has a second sloped surface. The trestle includes a top wall, a third side wall, a fourth side wall, and a support wall. The third side wall, the fourth side wall, and the support wall extend from the top wall in a second direction. The third side wall has a third sloped surface, and the fourth side wall has a fourth sloped surface. The positioning device mounts the trestle to the brace, is supported by the support wall, and is positioned to abut the positioning wall when mounting the trestle to the brace. At least a portion of the third sloped surface is positioned to slide along the first sloped surface under control of the positioning device, and at least a portion of the fourth sloped surface is positioned to slide along the second sloped surface under control of the positioning device to position the top wall of the trestle adjacent a door bracket of a hinge to support the door bracket relative to the surface of the door.

In another example embodiment, a hinge assembly is provided. The hinge assembly may include a device bracket, a door bracket, an arm, and a hinge support. The device bracket mounts to a device surface of a device. The door bracket mounts to a door of the device. The arm is mounted for rotation about a first pin and about a second pin, wherein the first pin is mounted to the device bracket and the second pin is mounted to the door bracket. The hinge support may include a brace, a trestle, and a positioning device. The brace mounts to a door surface of the door, and may include a base wall, a first side wall, a second side wall, and a positioning wall. The first side wall, the second side wall, and the positioning wall extend from the base wall in a first direction. The first side wall has a first sloped surface, and the second side wall has a second sloped surface. The trestle may include a top wall, a third side wall, a fourth side wall, and a support wall. The third side wall, the fourth side wall, and the support wall extend from the top wall in a second direction. The third side wall has a third sloped surface, and the fourth side wall has a fourth sloped surface. The positioning device mounts the trestle to the brace, is supported by the support wall, and is positioned to abut the positioning wall when mounting the trestle to the brace. At least a portion of the third sloped surface is positioned to slide along the first sloped surface under control of the positioning device and at least a portion of the fourth sloped surface is positioned to slide along the second sloped surface under control of the positioning device to position the top wall of the trestle adjacent the door bracket to support the door bracket relative to the door surface.

In another example embodiment, a device is provided. The device may include a body, a door, a hinge pivotally mounting the door to the body, and a hinge support. The hinge may include a device bracket mounted to a surface of the body, a door bracket mounted to the door, and an arm mounted for rotation about a first pin and about a second pin. The first pin is mounted to the device bracket, and the second pin is mounted to the door bracket. The hinge support may include a brace, a trestle, and a positioning device. The brace is mounted to a door surface of the door and may include a base wall, a first side wall, a second side wall, and a positioning wall. The first side wall, the second side wall, and the positioning wall extend from the base wall in a first direction opposite the door surface. The first side wall has a first sloped surface, and the second side wall has a second sloped surface. The trestle may include a top wall, a third side wall, a fourth side wall, and a support wall. The third side wall, the fourth side wall, and the support wall extend from the top wall in a second direction that is opposite the first direction. The third side wall has a third sloped surface, and the fourth side wall has a fourth sloped surface. The positioning device mounts the trestle to the brace, is supported by the support wall, and is positioned to abut the positioning wall when mounting the trestle to the brace. At least a portion of the third sloped surface is positioned to move along the first sloped surface under control of the positioning device and at least a portion of the fourth sloped surface is positioned to move along the second sloped surface under control of the positioning device to position the trestle adjacent the door bracket to support the door bracket relative to the door surface.

Other principal features and advantages of the invention will become apparent to those skilled in the art upon review of the following drawings, the detailed description, and the appended claims.

BRIEF DESCRIPTION OF THE DRAWINGS

Illustrative embodiments of the invention will hereafter be described with reference to the accompanying drawings, wherein like numerals denote like elements.

DETAILED DESCRIPTION

Figure 1:
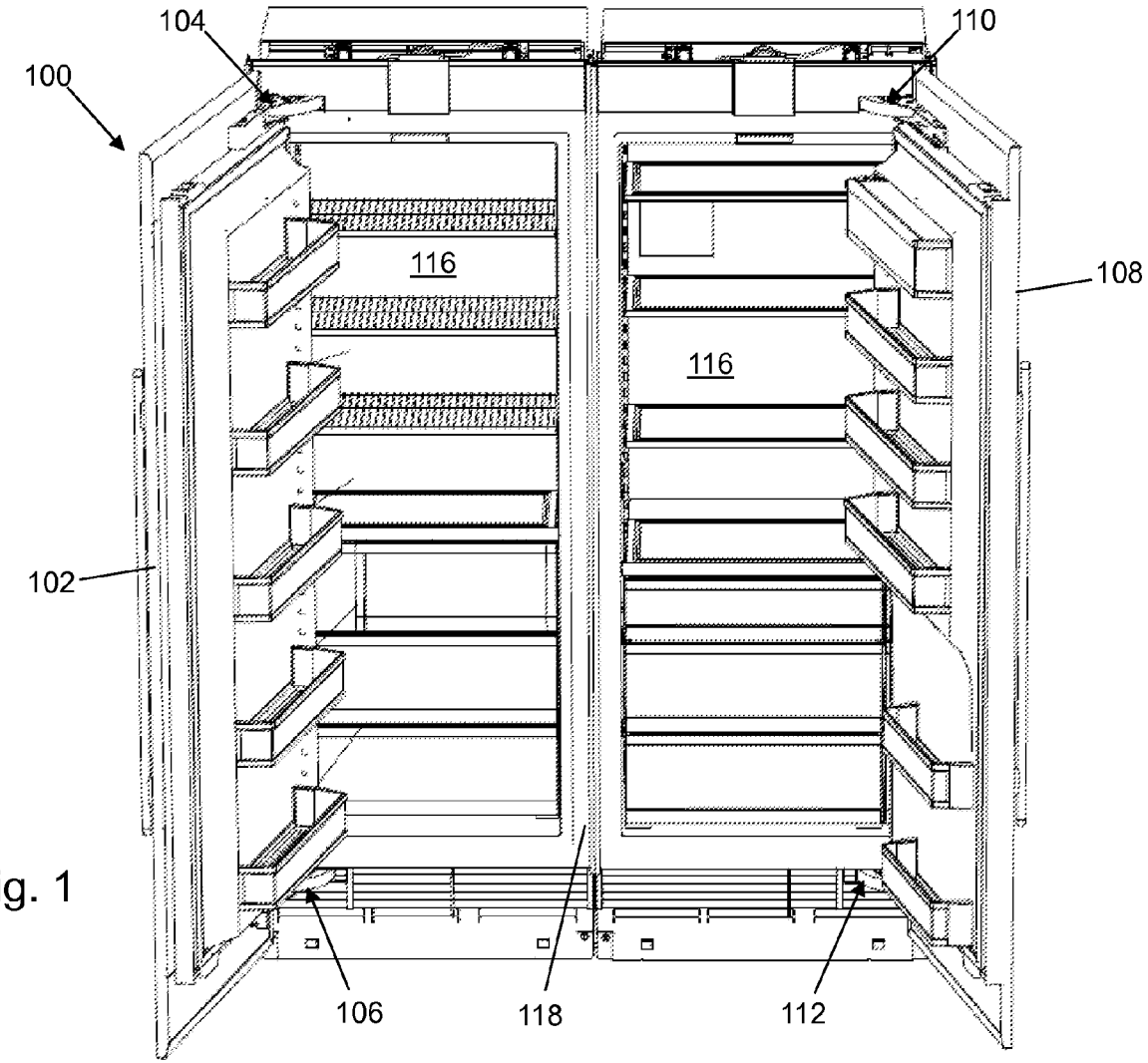
FIG. 1 depicts a perspective view of a device including a hinge and a hinge support in accordance with an illustrative embodiment.

With reference to FIG. 1, a device 100 is shown in accordance with an illustrative embodiment. Device 100 may include a first door 102, a first hinge 104, a second hinge 106, a second door 108, a third hinge 110, and a fourth hinge 112. Thus, in the illustrative embodiment, device 100 includes two doors with two hinges used to support each door. In alternative embodiments, the device may include a greater or a fewer number of doors and hinges. Merely for illustration, first door 102 provides access to a freezer space and second door 108 provides access to a refrigerated space.

Device 100 further may include a top wall 210 (shown with reference to FIG. 2), a bottom wall (not shown), a first side wall 306 (shown with reference to FIG. 3), a second side wall (not shown), a back wall 116, and a compartment wall 118. Device 100 defines a first enclosed space using first door 102, top wall 210, the bottom wall, the second side wall, back wall 116, and compartment wall 118. Device 100 defines a second enclosed space using second door 108, top wall 210, the bottom wall, first side wall 306, back wall 116, and compartment wall 118. However, device 100 need not define an enclosed space and may include a fewer or a greater number of walls. Though shown in the illustrative embodiment as forming generally rectangular shaped enclosures, device 100 may form any shaped enclosure including other polygons as well as circular or elliptical enclosures. As a result, first door 102, second door 108, and the walls forming device 100 may have any shape including other polygons as well as circular or elliptical shapes. In the illustrative embodiment, compartment wall 118 separates the refrigerated space from the freezer space and provides a contact surface for first door 102 and for second door 108 when the doors are closed.

First door 102 is pivotally mounted to the body of device 100 using first hinge 104 and second hinge 106. First hinge 104 mounts a top surface of first door 102 to top wall 210 of device 100. Second hinge 106 mounts a bottom surface of first door 102 to the bottom wall of device 100. Second door 108 is pivotally mounted to the body of device 100 using third hinge 110 and using fourth hinge 112. Third hinge 110 mounts a top surface of second door 108 to top wall 210 of device 100. Fourth hinge 112 mounts a bottom surface of second door 108 to the bottom wall of device 100. First hinge 104, second hinge 106, third hinge 110, and fourth hinge 112 may have the same or different structures.

Figure 2:
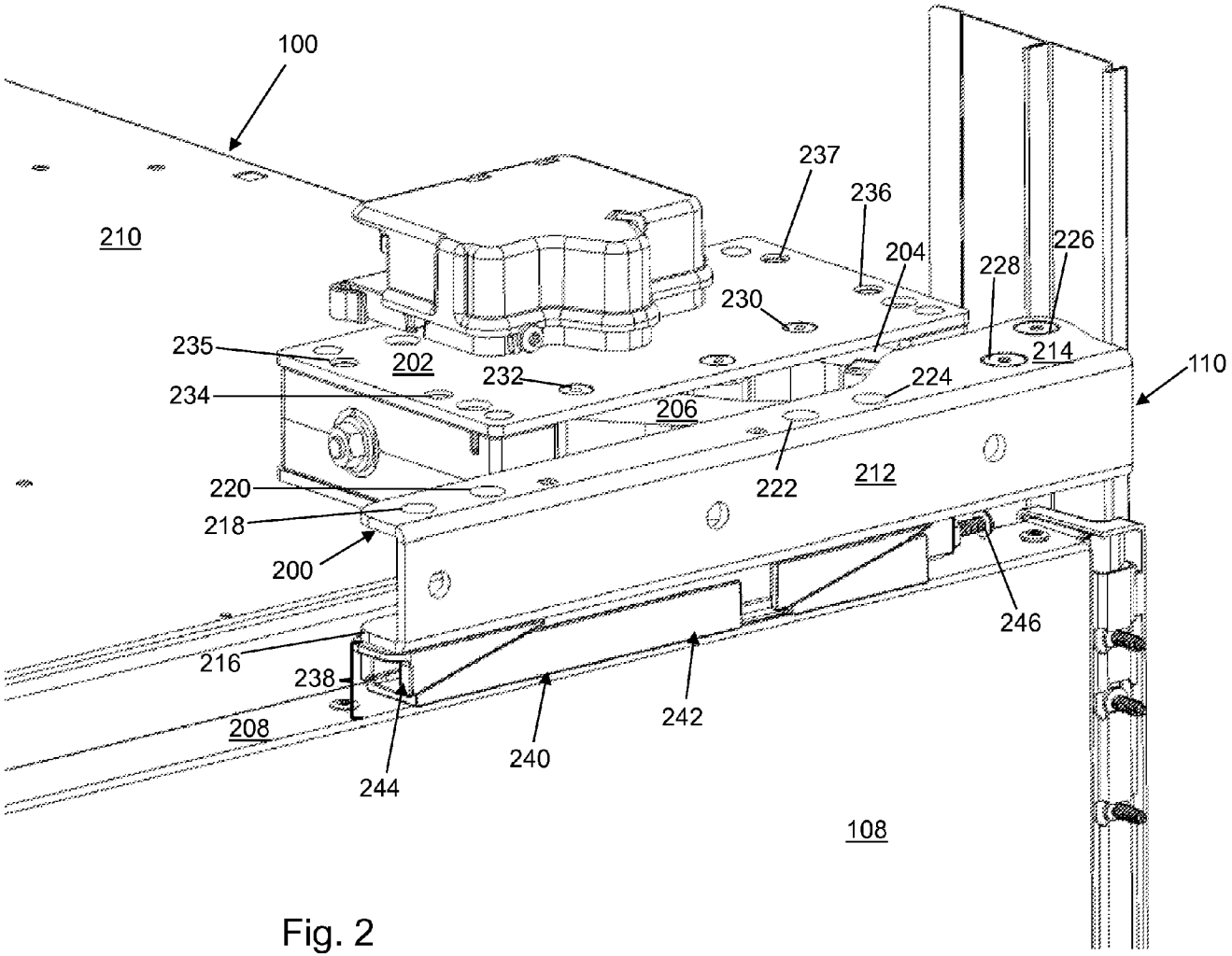
FIG. 2 depicts a left, perspective view of a portion of the device of FIG. 1 including the hinge and the hinge support in accordance with an illustrative embodiment.
Figure 3:
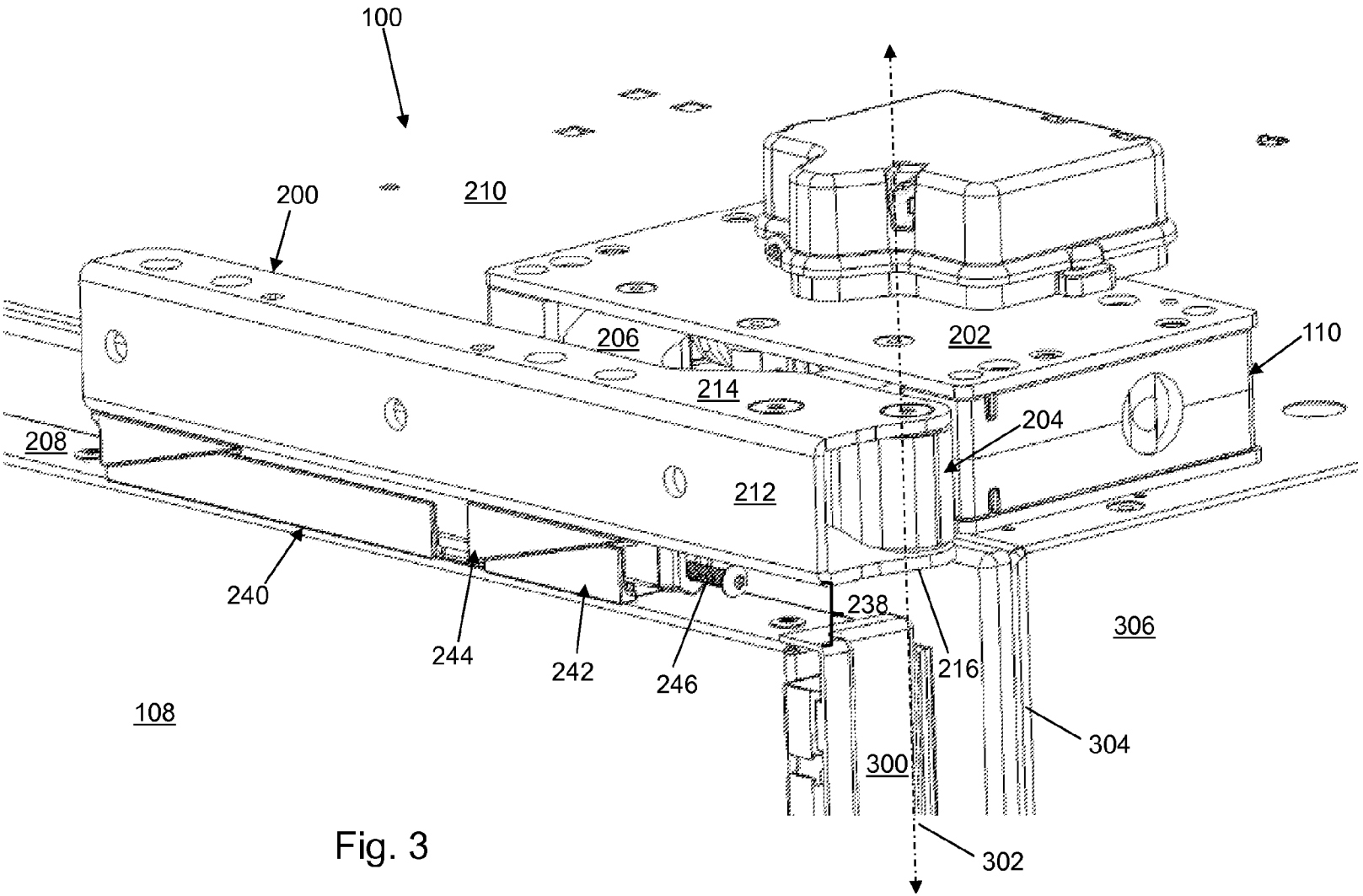
FIG. 3 depicts a right, perspective view of the portion of the device of FIG. 1 including the hinge and the hinge support in accordance with an illustrative embodiment.

With reference to FIG. 2, a front, left, perspective view of a portion of device 100 is shown in accordance with an illustrative embodiment. With reference to FIG. 3, a front, right, perspective view of the portion of device 100 is shown in accordance with an illustrative embodiment. Third hinge 110 mounts second door 108 for rotational movement of second door 108 relative to first side wall 306 of device 100.

In the illustrative embodiment, third hinge 110 includes a door bracket 200, a device bracket 202, a first arm 204, and a second arm 206. First arm 204 is mounted to device bracket 202 and to door bracket 200. Second arm 206 is mounted to device bracket 202 and to door bracket 200. Device bracket 202, door bracket 200, first arm 204, and second arm 206 form a 4-bar linkage as understood by a person of skill in the art. Other types of hinges may be used to mount second door 108 to a wall of device 100 without limitation. As used in this disclosure, the term "mount" includes join, unite, connect, couple, associate, insert, hang, hold, affix, attach, fasten, bind, paste, secure, bolt, screw, rivet, solder, weld, glue, form over, layer, and other like terms. The phrases "mounted on" and "mounted to" include any interior or exterior portion of the element referenced. These phrases also encompass direct mounting (in which the referenced elements are in direct contact) and indirect mounting (in which the referenced elements are not in direct contact).

In the illustrative embodiment, device bracket 202 is mounted to an exterior surface of top wall 210, and door bracket 200 is mounted to an exterior edge surface 208 of second door 108. In this context, exterior and interior are relative to any space formed by a confluence of the walls of device 100 though device 100 may not form a completely enclosed space. Of course, third hinge 110 may be mounted between any two adjacent surfaces of the walls of device 100. In the illustrative embodiment, first arm 204 and second arm 206 rotate in a plane parallel to at least the portion of the exterior surface of top wall 210 on which device bracket 202 is mounted. First arm 204 and second arm 206 are further mounted to device bracket 202 and to door bracket 200 to provide rotation of a door rotational edge 300 (shown with reference to FIG. 3) of second door 108 about an axis of rotation 302 (shown with reference to FIG. 3) that is parallel to at least a portion of door rotational edge 300 and to at least a corresponding portion of an edge 304 (shown with reference to FIG. 3) of first side wall 306. Door rotational edge 300 of second door 108 may translate relative to the remaining walls of device 100. As a result, axis of rotation 302 also translates relative to edge 304 of first side wall 306. In the illustrative embodiment, axis of rotation 302 is perpendicular to the plane that is parallel to at least the portion of the exterior surface of top wall 210 on which device bracket 202 is mounted. First arm 204 and second arm 206 rotate about pivot points 230 and 232, respectively.

Door bracket 200 of third hinge 110 may include a door bracket body 212, a door bracket top surface 214, a door bracket bottom surface 216, and a plurality of door mounting apertures. Use of directional terms, such as top, bottom, right, left, front, back, etc. are merely intended to facilitate reference to the various surfaces of the described structures relative to the orientations shown in the drawings and are not intended to be limiting in any manner. Door bracket bottom surface 216 extends from a bottom edge of door bracket body 212, and door bracket top surface 214 extends from a top edge of door bracket body 212. Door bracket bottom surface 216 and door bracket top surface 214 are generally parallel to exterior edge surface 208 of second door 108. Door bracket body 212 is generally perpendicular to door bracket bottom surface 216 and to door bracket top surface 214.

The plurality of door mounting apertures are formed through door bracket bottom surface 216 and door bracket top surface 214 to allow insertion of fasteners (not shown) to mount door bracket 200 to exterior edge surface 208 of second door 108. Illustrative fasteners include screws and rivets though other methods of mounting door bracket 200 to exterior edge surface 208 of second door 108 may be used. Of course, door bracket 200 may be mounted to other surfaces of second door 108. In the illustrative embodiment, the first plurality of door mounting apertures include a first pair of aligned apertures 218, a second pair of aligned apertures 220, a third pair of aligned apertures 222, and a fourth pair of aligned apertures 224. A fastener is inserted through the pairs of aligned apertures 218, 220, 222, 224 and into exterior edge surface 208 of second door 108 to mount door bracket 200 to second door 108.

First arm 204 rotatably mounts to door bracket 200 using a first arm door pin 226. First arm door pin 226 is inserted through a fifth pair of aligned apertures formed in door bracket 200 and through a first arm aperture in first arm 204. Second arm 206 rotatably mounts to door bracket 200 using a second arm door pin 228. Second arm door pin 228 is inserted through a sixth pair of aligned apertures formed in door bracket 200 and through a second arm aperture in second arm 206. First arm 204 rotatably mounts to device bracket 202 using a first arm device pin 230. First arm device pin 230 is inserted through a seventh pair of aligned apertures formed in device bracket 202 and through a third arm aperture in first arm 204. Second arm 206 rotatably mounts to device bracket 202 using a second arm device pin 232. Second arm device pin 232 is inserted through an eighth pair of aligned apertures formed in device bracket 202 and through a fourth arm aperture in second arm 206.

Device bracket 202 of third hinge 110 may include a plurality of device mounting apertures. The plurality of device mounting apertures are formed through device bracket 202 to allow insertion of fasteners to mount device bracket 202 to the exterior surface of top wall 210. Illustrative fasteners include screws and rivets though other methods of mounting device bracket 202 to the exterior surface of top wall 210 may be used. Of course, device bracket 202 may be mounted to other surfaces of device 100. In the illustrative embodiment, the plurality of device mounting apertures include a ninth pair of aligned apertures 234, a tenth pair of aligned apertures 235, an eleventh pair of aligned apertures 236, and a twelfth pair of aligned apertures 237. A fastener is inserted through the pairs of aligned apertures 234, 235, 236, 237 and into the exterior surface of top wall 210 to mount device bracket 202 to device 100.

With reference to FIGS. 2 and 3, a hinge support 240 of device 100 is shown in accordance with an illustrative embodiment. Hinge support 240 may include a brace 242, a trestle 244, and a positioning device. In the illustrative embodiment, the positioning device includes a screw 246 and a nut 400 (shown with reference to FIG. 4). Hinge support 240 is structured to provide a mechanism for filling a gap 238 between door bracket bottom surface 216 and exterior edge surface 208 of second door 108. Gap 238 may be a result of manufacturing tolerances that result in variations in the spacing between door bracket bottom surface 216 and exterior edge surface 208. The positioning device positions a top wall of trestle 244 adjacent door bracket bottom surface 216 to support door bracket 200 relative to exterior edge surface 208 of second door 108. As a result, hinge support 240 assists in maintaining door bracket 200 in a level position and in equally distributing the forces on the fasteners inserted in the pairs of aligned apertures 218, 220, 222, 224 of door bracket 200, which reduces the wear on third hinge 110.

Figure 4:
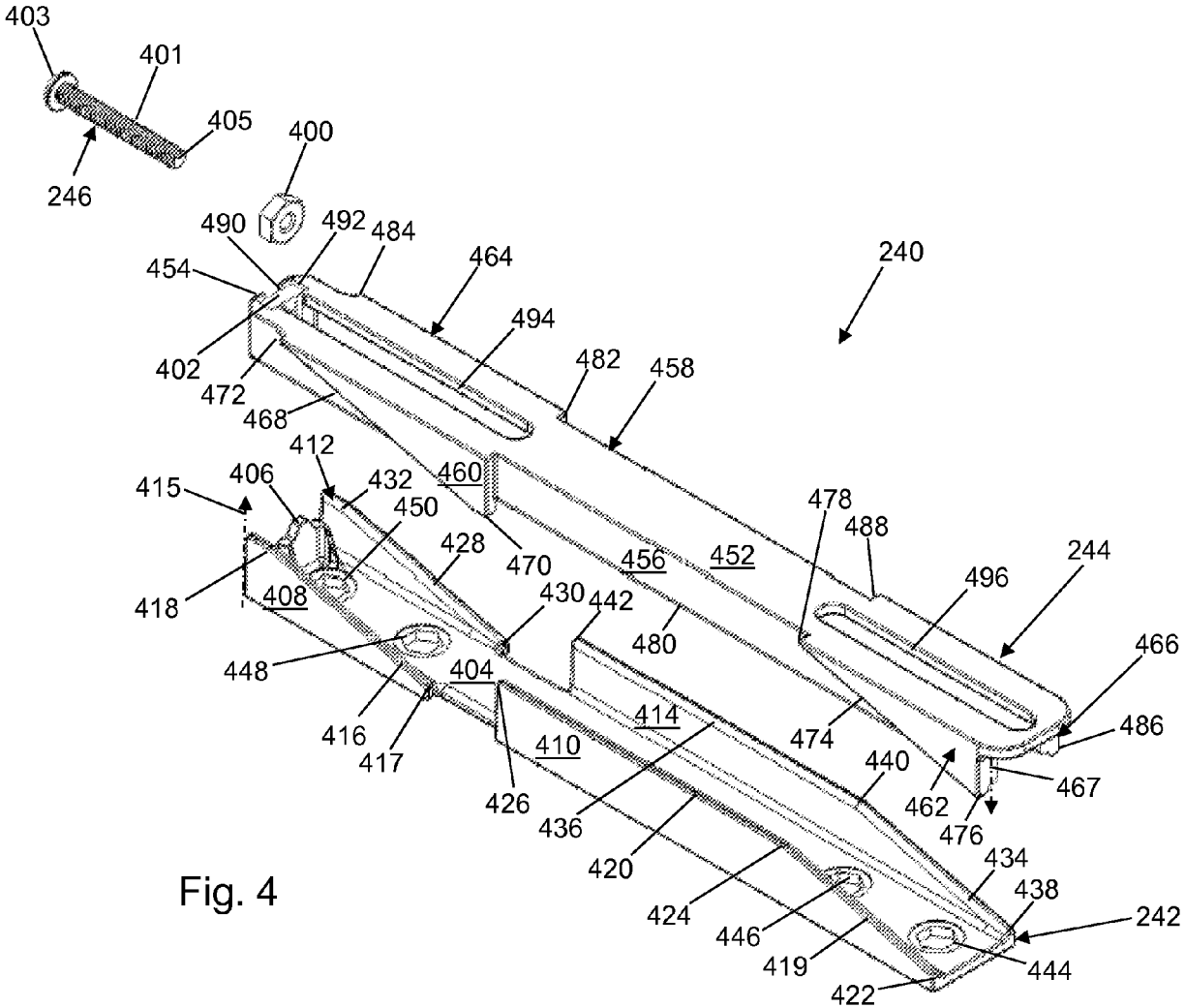
FIG. 4 depicts an exploded perspective view of the hinge support of FIG. 1 in accordance with an illustrative embodiment.

With reference to FIG. 4, an exploded view of hinge support 240 is shown in accordance with an illustrative embodiment. Screw 246 includes a shaft 401, a head 403, and an end 405 of shaft 401 that is opposite head 403. Brace 242 is mounted to exterior edge surface 208 of second door 108 as shown with reference to FIG. 6. With continuing reference to FIG. 4, brace 242 may include a base wall 404, a first side wall, a second side wall, and a positioning wall 406. In the illustrative embodiment, the first side wall includes a first side wall portion 408 and a second side wall portion 410, and the second side wall includes a third side wall portion 412 and a fourth side wall portion 414. First side wall portion 408, second side wall portion 410, third side wall portion 412, fourth side wall portion 414, and positioning wall 406 extend from base wall 404 in a first direction 415.

First side wall portion 408 includes a first sloped surface 416 that extends between a first edge 417 and a second edge 418 of first side wall portion 408. Second side wall portion 410 includes a second sloped surface 419 and a first flat surface 420. Second sloped surface 419 extends between a first edge 422 and a second edge 424 of second side wall portion 410. First flat surface 420 extends between second edge 424 and a third edge 426 of second side wall portion 410. Between first edge 417 of first side wall portion 408 and third edge 426 of second side wall portion 410, no side wall extends from base wall 404.

Third side wall portion 412 includes a third sloped surface 428 that extends between a first edge 430 and a second edge 432 of third side wall portion 412. Fourth side wall portion 414 includes a fourth sloped surface 434 and a second flat surface 436. Fourth sloped surface 434 extends between a first edge 438 and a second edge 440 of fourth side wall portion 414. Second flat surface 436 extends between second edge 440 and a third edge 442 of fourth side wall portion 414. Between first edge 430 of third side wall portion 412 and third edge 442 of fourth side wall portion 414, no side wall extends from base wall 404. Between first edge 422 of second side wall portion 410 and first edge 438 of fourth side wall portion 414, no side wall extends from base wall 404.

Base wall 404 may include a first aperture 444, a second aperture 446, a third aperture 448, and a fourth aperture 450. First aperture 444, second aperture 446, third aperture 448, and fourth aperture 450 are formed through base wall 404 to allow insertion of fasteners to mount door bracket 200 and support hinge 240 to exterior edge surface 208 of second door 108. The first pair of aligned apertures 218, the second pair of aligned apertures 220, the third pair of aligned apertures 222, and the fourth pair of aligned apertures 224 are aligned with first aperture 444, second aperture 446, third aperture 448, and fourth aperture 450, respectively. A fastener is inserted through the pairs of aligned apertures 218, 220, 222, 224, through first aperture 444, second aperture 446, third aperture 448, and fourth aperture 450, and into exterior edge surface 208 of second door 108 to mount door bracket 200 to second door 108. Base wall 404 may include a fewer or a greater number of apertures.

Trestle 244 is positioned over brace 242. Trestle 244 may include a top wall 452, a support wall 454, a first side wall 456, and a second side wall 458. First side wall 456, second side wall 458, and support wall 454 extend from top wall 452 in a second direction 467 that is 180 degrees relative to first direction 415. Thus, first direction 415 and second direction 467 are parallel. In the illustrative embodiment, first side wall 456 includes a fifth side wall portion 460 and a sixth side wall portion 462, and second side wall 458 includes a seventh side wall portion 464 and an eighth side wall portion 466. Fifth side wall portion 460 and sixth side wall portion 462 are formed on first side wall 456. Seventh side wall portion 464 and eighth side wall portion 466 are formed on second side wall 458.

Fifth side wall portion 460 includes a fifth sloped surface 468 that extends between a first edge 470 and a second edge 472 of fifth side wall portion 460. Sixth side wall portion 462 includes a sixth sloped surface 474 that extends between a first edge 476 and a second edge 478 of sixth side wall portion 462. Between first edge 470 of fifth side wall portion 460 and second edge 478 of sixth side wall portion 462, no wall portion is formed on first side wall 456.

Seventh side wall portion 464 includes a seventh sloped surface 700 (shown with reference to FIG. 7) that extends between a first edge 482 and a second edge 484 of seventh side wall portion 464. Eighth side wall portion 466 includes a fourth sloped surface 702 (shown with reference to FIG. 7) that extends between a first edge 486 and a second edge 488 of eighth side wall portion 466. Between first edge 482 of seventh side wall portion 464 and second edge 488 of eighth side wall portion 466, no wall portion is formed on second side wall 458.

Support wall 454 includes a slot 490 formed in support wall 454 to support shaft 401 of screw 246. A nut support platform 492 is formed in top wall 452 between first side wall 456 and second side wall 458 and is positioned adjacent support wall 454. Nut support platform 492 is sized and shaped to accommodate nut 400 which is positioned in nut support platform 492 as shown with reference to FIG. 6.

Figure 9:
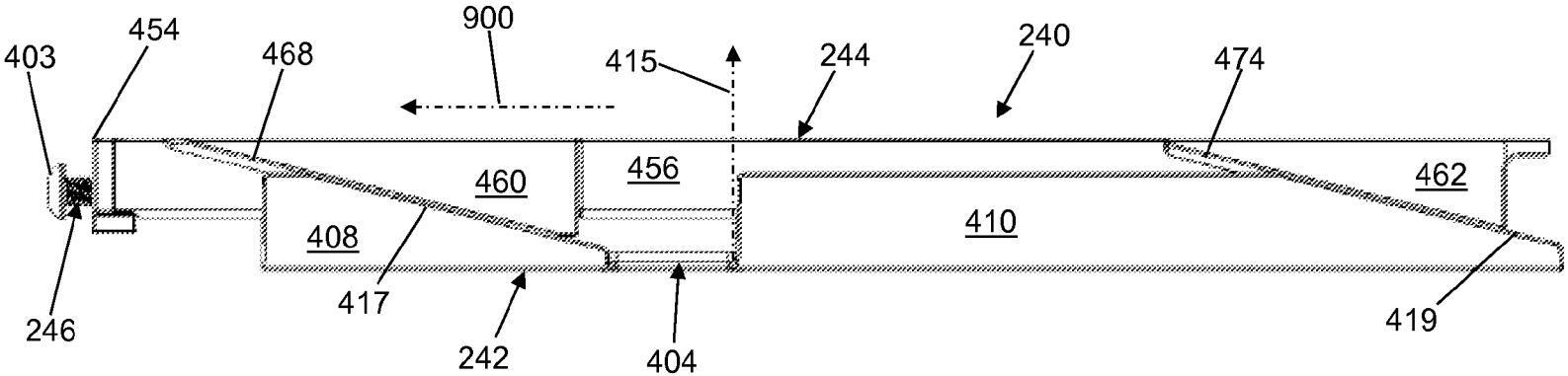
FIG. 9 depicts a side view of the hinge support of FIG. 4 in a partially raised position in accordance with an illustrative embodiment.

With continuing reference to FIG. 4, top wall 452 includes a first elongated slot 494 and a second elongated slot 496 formed through top wall 452 to allow insertion of fasteners to mount door bracket 200 and support hinge 240 to exterior edge surface 208 of second door 108, and to allow trestle 244 to move in a direction perpendicular to second direction 467 or third direction 900 as shown with reference to FIG. 9. Second direction 467 is approximately perpendicular to a plane defined by a top surface of top wall 452 and third direction 900 is parallel to the plane.

With continuing reference to FIG. 4, trestle 244 can translate relative to brace 242 in first direction 415, in second direction 467, and in the plane defined by the top surface of top wall 452. The top surface of top wall 452, base wall 404, and exterior edge surface 208 of second door 108 are approximately parallel. Thus, in the illustrative embodiment of FIG. 2, trestle 244 can move horizontally in the plane defined by base wall 404 and vertically in a plane defined by first direction 415 and second direction 467.

First elongated slot 494 is positioned over third aperture 448 and over fourth aperture 450 when trestle 244 is mounted to brace 242. First elongated slot 494 has a length measured in the plane defined by the top surface of top wall 452 that is greater than the distance moved by trestle 244 in that plane. Additionally, in the illustrative embodiment, the length of first elongated slot 494 includes the distance between third aperture 448 and fourth aperture 450. Second elongated slot 496 is positioned over first aperture 444 and over second aperture 446 when trestle 244 is mounted to brace 242. Second elongated slot 496 has a length measured in the plane defined by the top surface of top wall 452 that is greater than the distance moved by trestle 244 in that plane. Additionally, in the illustrative embodiment, the length of second elongated slot 496 includes the distance between first aperture 444 and second aperture 446. Top wall 452 may include a fewer or a greater number of elongated slots.

A first fastener 704 (shown with reference to FIG. 7) is inserted through the fourth pair of aligned apertures 224 (not shown), through first elongated slot 494, through fourth aperture 450 and into exterior edge surface 208 of second door 108 to mount door bracket 200 to second door 108. A second fastener 706 (shown with reference to FIG. 7) is inserted through the third pair of aligned apertures 222 (not shown), through first elongated slot 494, through third aperture 448 and into exterior edge surface 208 of second door 108 to mount door bracket 200 to second door 108. A third fastener 708 (shown with reference to FIG. 7) is inserted through the second pair of aligned apertures 220 (not shown), through second elongated slot 496, through second aperture 446 and into exterior edge surface 208 of second door 108 to mount door bracket 200 to second door 108. A fourth fastener 710 (shown with reference to FIG. 7) is inserted through the first pair of aligned apertures 218 (not shown), through second elongated slot 496, through first aperture 444 and into exterior edge surface 208 of second door 108 to mount door bracket 200 to second door 108. A fewer or a greater number of fasteners and corresponding apertures/elongated slots may be used in alternative embodiments.

Figure 5:
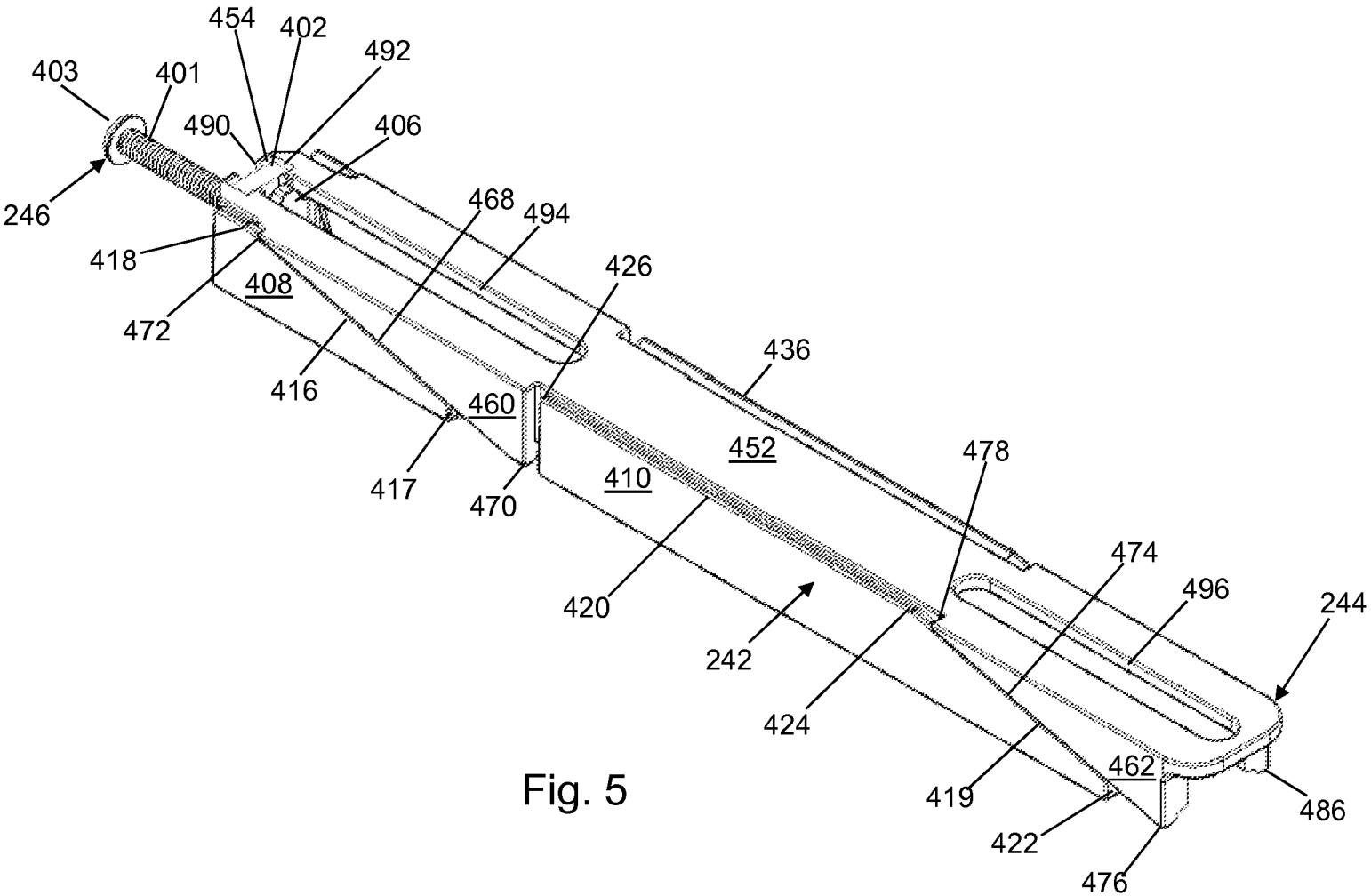
FIG. 5 depicts a perspective view of the hinge support of FIG. 4 in accordance with an illustrative embodiment.

As shown with reference to FIG. 5, trestle 244 is mounted to rest on brace 242 such that a bottom edge 480 of first side wall 456 abuts a top surface of base wall 404. In the illustrative embodiment, first side wall 456 fits within first side wall portion 408 and second side wall portion 410, and second side wall 458 fits within third side wall portion 412 and fourth side wall portion 414 when trestle 244 is mounted to brace 242. At least a portion of fifth sloped surface 468 is positioned on first sloped surface 416 when trestle 244 is mounted to brace 242. At least a portion of sixth sloped surface 474 is positioned on second sloped surface 419 when trestle 244 is mounted to brace 242. At least a portion of seventh sloped surface 700 is positioned on third sloped surface 428 when trestle 244 is mounted to brace 242. At least a portion of eighth sloped surface 702 is positioned on fourth sloped surface 434 when trestle 244 is mounted to brace 242. A portion of positioning wall 406 may extend through first elongated slot 494.

Figure 6:
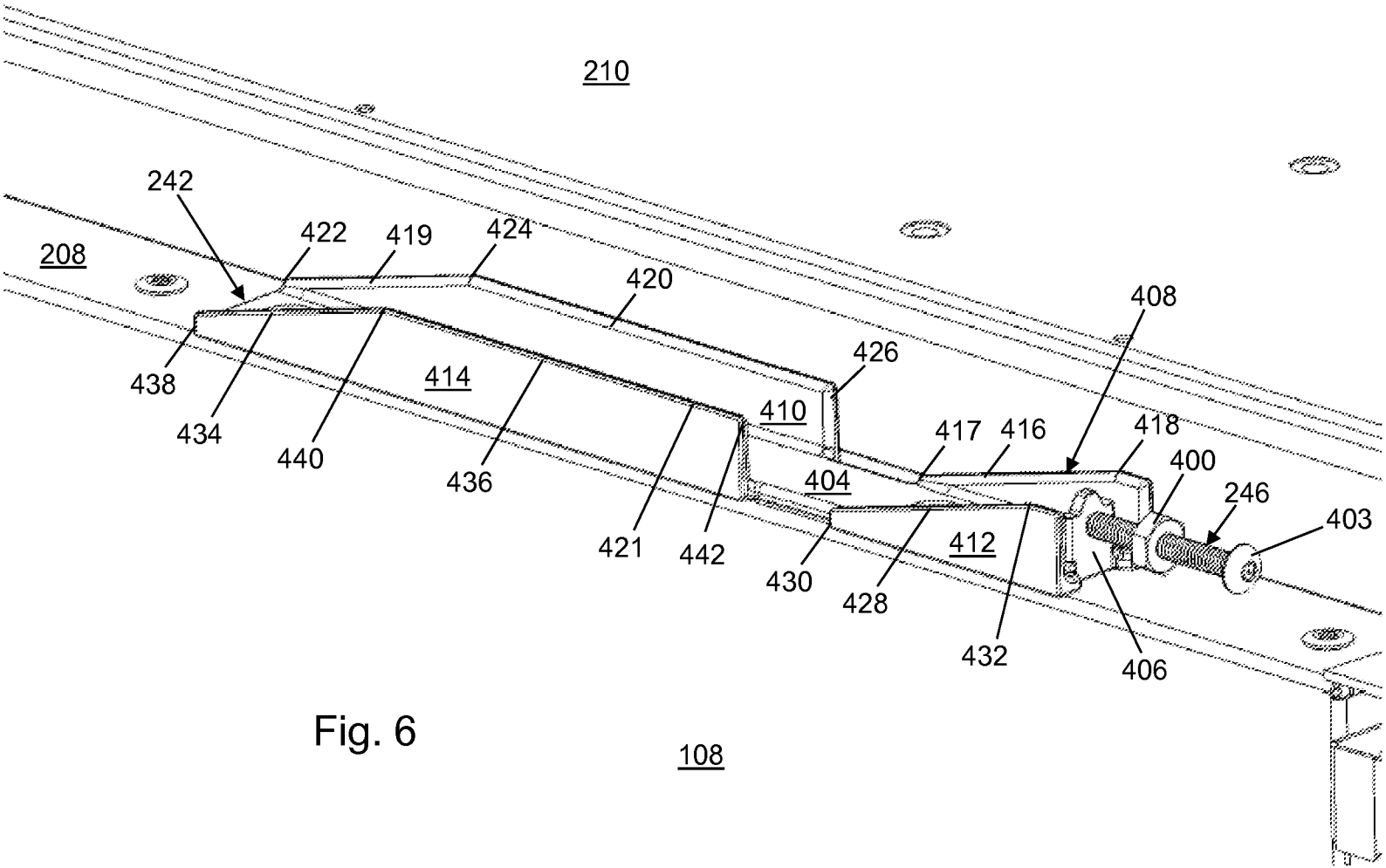
FIG. 6 depicts a right, perspective view of a brace of the hinge support of FIG. 4 in accordance with an illustrative embodiment.

As shown with reference to FIG. 6, brace 242 is mounted to exterior edge surface 208 of second door 108. End 405 of screw 246 abuts positioning wall 406. As shown with reference to FIG. 7, nut 400 is positioned in nut support platform 492. As shown with reference to FIGS. 4 and 5, a cap 402 is positioned over nut support platform 492 to hold nut 402 in nut support platform 492. As shown with reference to FIG. 7, shaft 401 includes a threaded surface that is threaded into nut 400 such that end 405 of screw 246 abuts positioning wall 406. Shaft 401 is supported by slot 490 of support wall 454.

Figure 7:
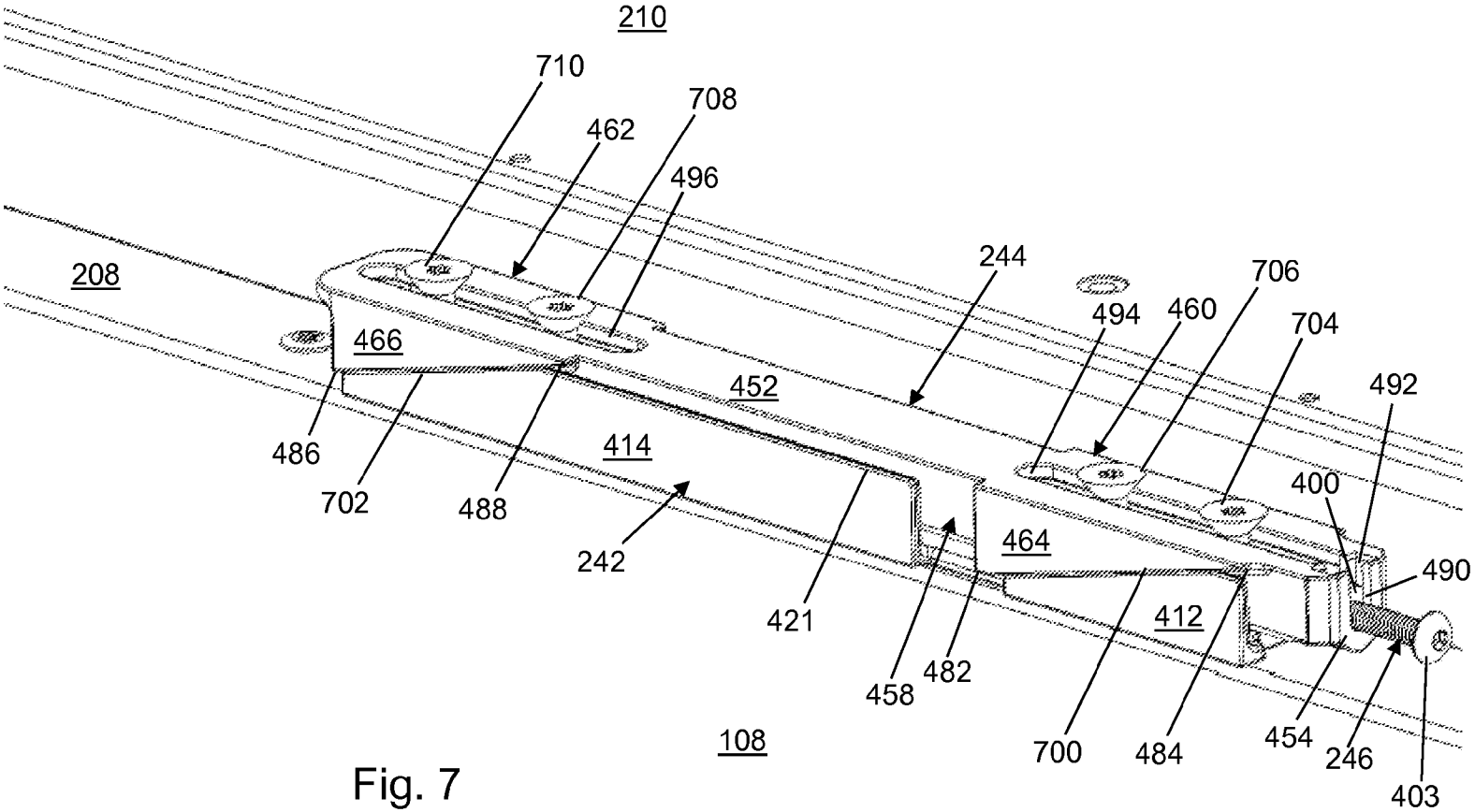
FIG. 7 depicts a right, perspective view of the hinge support of FIG. 4 in accordance with an illustrative embodiment.
Figure 8:
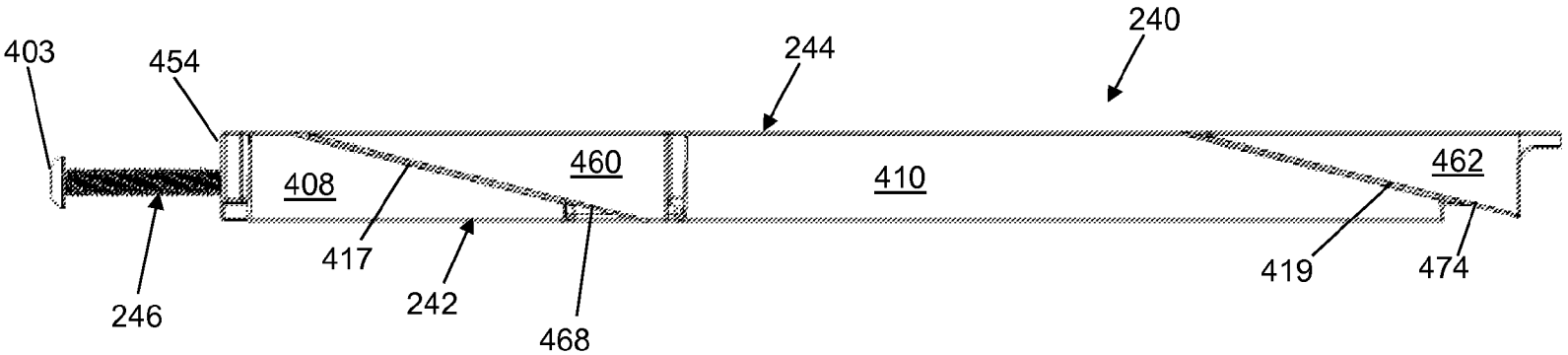
FIG. 8 depicts a side view of the hinge support of FIG. 4 in a lowered position in accordance with an illustrative embodiment.

As shown with reference to FIGS. 7, 8, and 9, rotation of head 403 of screw 246 moves trestle 244 vertically in first direction 415 and horizontally in third direction 900 with respect to brace 242. FIG. 8 shows hinge support 240 in a lowered position. FIG. 9 shows hinge support 240 in a partially raised position. Rotation of head 403 causes at least a portion of fifth sloped surface 468 to slide along first sloped surface 416, at least a portion of sixth sloped surface 474 to slide along second sloped surface 419, at least a portion of seventh sloped surface 700 to slide along third sloped surface 428, and at least a portion of eighth sloped surface 702 to slide along fourth sloped surface 434.

Positioning wall 406 has a height measured in first direction 415 that is greater than a distance moved by trestle 244 in first direction 415 because, as trestle 244 moves vertically, so does nut support platform 492, nut 400, and end 405 of screw 246. As a result, the height of positioning wall 406 is large enough to support the vertical movement of end 405 of screw 246.

Fifth sloped surface 468 and first sloped surface 416 have complementary slopes, sixth sloped surface 474 and second sloped surface 419 have complementary slopes, seventh sloped surface 700 and third sloped surface 428 have complementary slopes, and eighth sloped surface 702 and fourth sloped surface 434 have complementary slopes. In an illustrative embodiment, the slopes of first sloped surface 416, second sloped surface 419, third sloped surface 428, and fourth sloped surface 434 are the same and in the range from approximately 1 degree to 89 degrees. In an illustrative embodiment, the slopes of fifth sloped surface 468, sixth sloped surface 474, seventh sloped surface 700, and eighth sloped surface 702 are the same and in the range from approximately 1 degree to 89 degrees. In alternative embodiments, there may be a fewer or a greater number of sloped surfaces and the sloped surfaces may be sloped in different directions.

The dimensions of the components of support hinge 240 may be selected based on the dimensions of second door 108, the dimension of third hinge 110, and/or the expected manufacturing tolerances. Brace 242 and trestle 244 have been shown as being formed of a single piece of material. In alternative embodiments, brace 242 and trestle 244 may be formed of a plurality of pieces of the same or different materials. The components of third hinge 110 and hinge support 240 described herein may be formed of one or more metals or plastics having a sufficient strength and rigidity for the described application possibly dependent on device 100 and a size and weight of second door 108.

In an illustrative embodiment, brace 242 is positioned on exterior edge surface 208 of second door 108, and trestle 244 is positioned over brace 242 such that trestle 244 is in the lowered position as shown with reference to FIG. 8. Nut 400 is positioned within nut support platform 492, and shaft 401 is threaded into nut 400 such that end 405 of screw 246 abuts positioning wall 406. Shaft 401 is supported by slot 490 of support wall 454. Door bracket 200 is positioned over trestle 244 such that the pairs of aligned apertures 218, 220, 222, 224 are centered over first aperture 444, second aperture 446, third aperture 448, and fourth aperture 450, respectively. First fastener 704 is inserted through the fourth pair of aligned apertures 224, through first elongated slot 494, through fourth aperture 450 and into exterior edge surface 208 of second door 108. Second fastener 706 is inserted through the third pair of aligned apertures 222, through first elongated slot 494, through third aperture 448 and into exterior edge surface 208 of second door 108. Third fastener 708 is inserted through the second pair of aligned apertures 220, through second elongated slot 496, through second aperture 446 and into exterior edge surface 208 of second door 108 to mount door bracket 200 to second door 108. Fourth fastener 710 is inserted through the first pair of aligned apertures 218, through second elongated slot 496, through first aperture 444 and into exterior edge surface 208 of second door 108. The fasteners 704, 706, 708, 710 are tightened to mount door bracket 200 to second door 108. Fasteners are inserted in the pairs of aligned apertures 234, 235, 236, 237 and into the exterior surface of top wall 210 to mount device bracket 202 to device 100. Head 403 of screw 246 is rotated until top wall 452 abuts a bottom surface of door bracket bottom surface 216.

Figure 10:
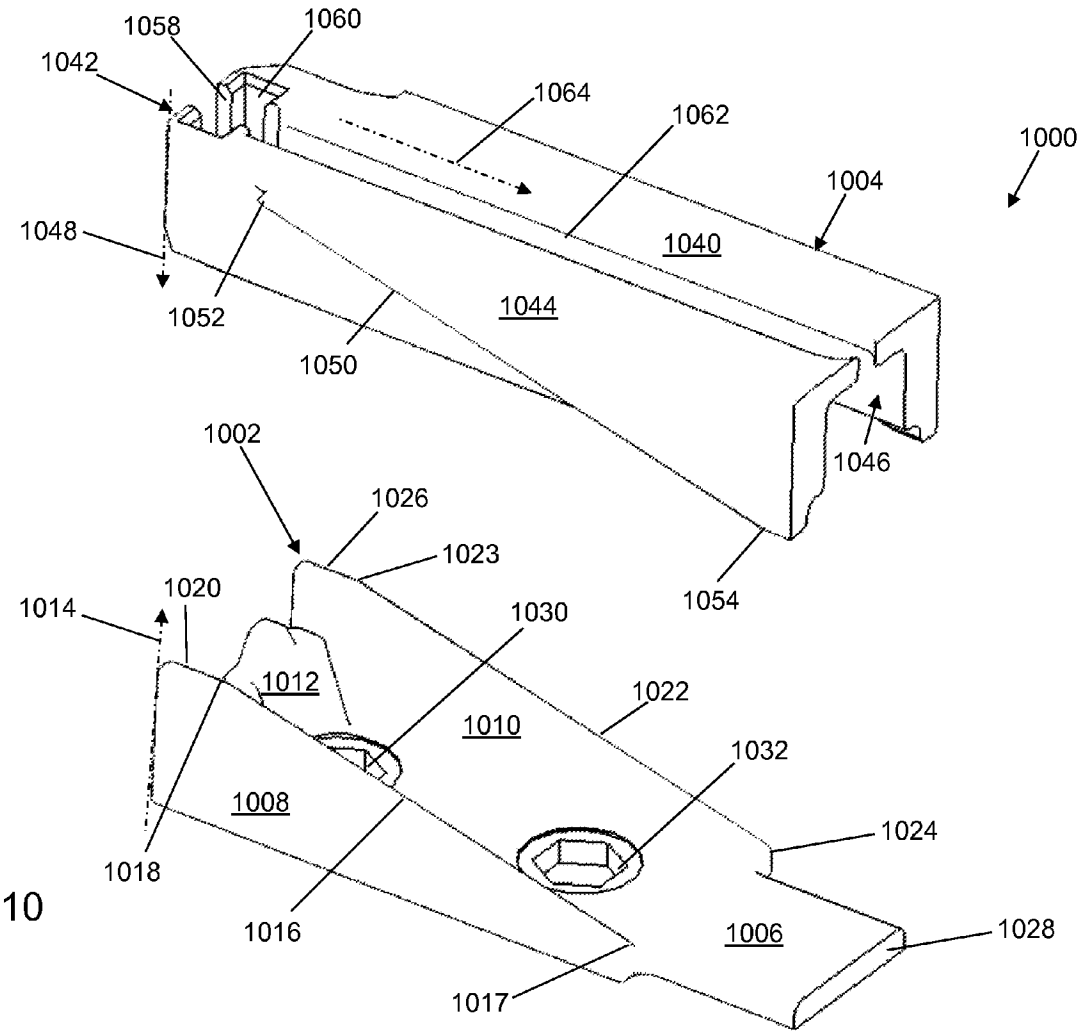
FIG. 10 depicts an exploded perspective view of a hinge support in accordance with a second illustrative embodiment.
Figure 11:
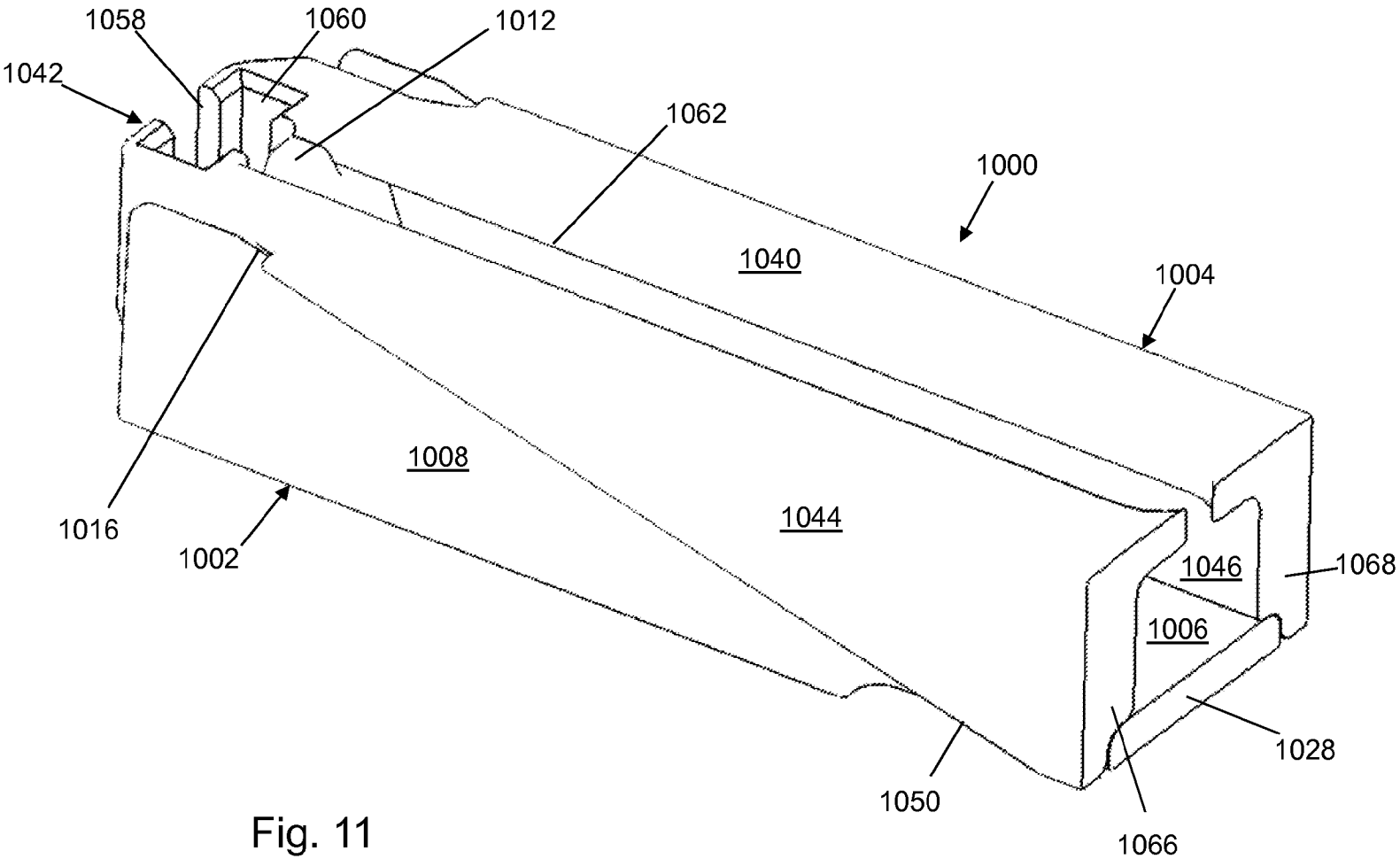
FIG. 11 depicts a perspective view of the hinge support of FIG. 10 in accordance with a second illustrative embodiment.

With reference to FIGS. 10 and 11, a second hinge support 1000 of device 100 is shown in accordance with a second illustrative embodiment. Second hinge support 1000 may include a second brace 1002, a second trestle 1004, and a second positioning device (not shown). Second hinge support 1000 is structured to provide a mechanism for filling gap 238 between door bracket bottom surface 216 and exterior edge surface 208 of second door 108. In an illustrative embodiment, the second positioning device may include screw 246 and nut 400 though other positioning devices may be used to provide adjustment of the position of second trestle 1004 with respect to second brace 1002 to at least partially fill gap 238 as discussed previously.

With reference to FIG. 10, an exploded view of second hinge support 1000 is shown in accordance with the second illustrative embodiment. Second brace 1002 can be mounted to exterior edge surface 208 of second door 108. Second brace 1002 may include a base wall 1006, a first side wall 1008, a second side wall 1010, a positioning wall 1012, and a stop wall 1028. First side wall 1008, second side wall 1010, positioning wall 1012, and stop wall 1028 of second brace 1002 extend from base wall 1006 of second brace 1002 in a first direction 1014.

First side wall 1008 includes a first sloped surface 1016 that extends between a first edge 1017 and a second edge 1018 of first side wall 1008 and a first flat surface 1020. Second side wall 1010 includes a second sloped surface 1022 that extends between a first edge 1023 and a second edge 1024 of second side wall 1010 and a second flat surface 1026. Between first edge 1017 of first side wall 1008 and stop wall 1028 and between first edge 1023 of second side wall 1010 and stop wall 1028, no side wall extends from base wall 1006.

Base wall 1006 of second brace 1002 may include a first aperture 1030 and a second aperture 1032. First aperture 1030 and second aperture 1032 are formed through base wall 1006 of second brace 1002 to allow insertion of fasteners to mount door bracket 200 and second support hinge 1000 to exterior edge surface 208 of second door 108. The first pair of aligned apertures 218 and the second pair of aligned apertures 220 may be aligned with first aperture 1030 and second aperture 1032, respectively. As another option, the third pair of aligned apertures 222, and the fourth pair of aligned apertures 224 may be aligned with first aperture 1030 and second aperture 1032, respectively. A fastener is inserted through the pairs of aligned apertures 218, 220, 222, 224, through first aperture 1030 and through second aperture 1032, and into exterior edge surface 208 of second door 108 to mount door bracket 200 to second door 108. Base wall 1006 of second brace 1002 may include a fewer or a greater number of apertures.

Second trestle 1004 is positioned over second brace 1002. Second trestle 1004 may include a top wall 1040, a support wall 1042, a first side wall 1044, and a second side wall 1046. First side wall 1044, second side wall 1046, and support wall 1042 extend from top wall 1040 in a second direction 1048 that is 180 degrees relative to first direction 1014. Thus, first direction 1014 and second direction 1048 are parallel. First side wall 1044 of second trestle 1004 includes a third sloped surface 1050 that extends between a first edge 1052 and a second edge 1054 of first side wall 1044. Second side wall 1046 of second trestle 1004 includes a fourth sloped surface (not shown) that extends between a first edge (not shown) and a second edge (not shown) of seventh side wall 1046. Support wall 1042 of second trestle 1004 includes a slot 1058 formed in support wall 1042 to support shaft 401 of screw 246. A nut support platform 1060 is formed in top wall 1040 between first side wall 1044 and second side wall 1046 and is positioned adjacent support wall 1042. Nut support platform 1060 is sized and shaped to accommodate nut 400 which is positioned in nut support platform 1046.

Top wall 1040 of second trestle 1004 includes a first elongated slot 1062 formed through top wall 1040 to allow insertion of fasteners to mount door bracket 200 and second support hinge 1000 to exterior edge surface 208 of second door 108, and to allow second trestle 1004 to move in a direction parallel to first direction 1014 and to a third direction 1064. First direction 1014 is approximately perpendicular to a plane defined by a top surface of top wall 1040 and third direction 1064 is parallel to the plane. Second trestle 1004 can translate relative to second brace 1002 in first direction 1014, in second direction 1048, and in the plane defined by the top surface of top wall 1040. The top surface of top wall 1040, base wall 1006, and exterior edge surface 208 of second door 108 are approximately parallel.

First elongated slot 1062 is positioned over first aperture 1030 and second aperture 1032 when second trestle 1004 is mounted to second brace 1002. First elongated slot 1062 has a length measured in the plane defined by the top surface of top wall 1040 that is greater than the distance moved by second trestle 1004 in that plane. Additionally, in the illustrative embodiment, the length of first elongated slot 1062 includes the distance between first aperture 1030 and second aperture 1032. Top wall 1004 may include a fewer or a greater number of elongated slots.

As shown with reference to FIG. 11, second trestle 1004 is mounted to rest on second brace 1002 such that a first edge 1066 of first side wall 1044 of second trestle 1004 abuts stop wall 1028 and a second edge 1068 of second side wall 1046 of second trestle 1004 abuts stop wall 1028. At least a portion of first sloped surface 1050 of second trestle 1004 is positioned on first sloped surface 1016 of second brace 1002 when second trestle 1004 is mounted to second brace 1002. At least a portion of the second sloped surface of second trestle 1004 is positioned on second sloped surface 1022 of second brace 1002 when second trestle 1004 is mounted to second brace 1002. A portion of positioning wall 406 may extend through first elongated slot 1062.

Though the illustrative embodiments include the positioning device, the positioning device is not required in alternative embodiments. For example, friction between the sloped surfaces of the side walls of trestle 244 and brace 242 after insertion of the fasteners to mount door bracket 200 to exterior edge surface 208 of second door 108 may provide sufficient force to mount trestle 244 in abutment at the desired location on brace 242. Thus, hinge support 240 may not include screw 246, nut 400, or cap 402. Further, hinge support 240 may not include positioning wall 406 of brace 242 or support wall 454, nut support platform 492, and slot 490 of trestle 244. Similarly, friction between the sloped surfaces of the side walls of second trestle 1004 and second brace 1002 after insertion of the fasteners to mount door bracket 200 to exterior edge surface 208 of second door 108 may provide sufficient force to mount second trestle 1004 in abutment at the desired location on second brace 1002. Thus, second hinge support 1000 may not include screw 246, nut 400, or cap 402. Further, second hinge support 1000 may not include positioning wall 1012 of second brace 1002 or support wall 1042, nut support platform 1060, and slot 1058 of second trestle 1004.

Though the illustrative embodiments include sloped surfaces that are generally smooth, smooth surfaces are not required for the sloped surface of trestle 244 and brace 242. For example, the sloped surfaces of the side walls of trestle 244 and brace 242 may include a plurality of stepped surfaces that are complimentary and allow adjustment of the position of abutment of trestle 1004 with brace 1002. Similarly, the sloped surfaces of the side walls of second trestle 1004 and second brace 1002 may include a plurality of stepped surfaces that are complimentary and allow adjustment of the position of abutment of second trestle 1004 with second brace 1002. As another alternative embodiment, the sloped surfaces of the side walls of trestle 244 and brace 242 may include a textured surface. In these alternative embodiments, the positioning device is not required, though it may be included.

In the illustrative embodiments, a channel is formed between the sloped surfaces of the side walls of hinge support 240 and the sloped surfaces of the side walls of second hinge support 1000. However, in alternative embodiments, the sloped surfaces of the side walls may be joined by a solid surface. For example, a first surface may connect at least a portion of first sloped surface 1016 of second brace 1002 to second sloped surface 1022 of second brace 1002, and/or a second surface may connect at least a portion of first sloped surface 1050 of second trestle 1004 to second sloped surface of second trestle 1004. The first surface may extend all or part of the way towards base wall 1006 of second brace 1002, and/or the second surface may extend all or part of the way towards top wall 1040 of second trestle 1004. A similar modification may be made to the sloped surfaces of hinge support 240. In these alternative embodiments, the positioning device is not required, though it may be included. Additionally, in these alternative embodiments, the sloped surfaces may include a plurality of stepped surfaces that are complimentary.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, the use of "and" or "or" is intended to include "and/or" unless specifically indicated otherwise.

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A hinge support comprising:

a brace configured for mounting to a surface of a door, wherein the brace comprises a base wall, a first side wall, a second side wall, and a positioning wall, wherein the first side wall, the second side wall, and the positioning wall extend from the base wall in a first direction, and further wherein the first side wall has a first sloped surface, and the second side wall has a second sloped surface;

a trestle comprising a top wall, a third side wall, a fourth side wall, and a support wall, wherein the third side wall, the fourth side wall, and the support wall extend from the top wall in a second direction, and further wherein the third side wall has a third sloped surface, and the fourth side wall has a fourth sloped surface; and a positioning device configured for mounting the trestle to the brace, wherein the positioning device is supported by the support wall and positioned to abut the positioning wall when mounting the trestle to the brace, and further wherein at least a portion of the third sloped surface is positioned to slide along the first sloped surface under control of the positioning device and at least a portion of the fourth sloped surface is positioned to slide along the second sloped surface under control of the positioning device to position the top wall of the trestle adjacent a door bracket of a hinge to support the door bracket relative to the surface of the door.

2. The hinge support of claim 1, wherein the positioning device comprises:

a nut; and a screw including a shaft and a head, wherein the shaft includes a threaded surface, wherein the threaded surface is threaded into the nut.

3. The hinge support of claim 2, wherein the trestle further comprises a nut support platform, and the nut is positioned in the nut support platform.

4. The hinge support of claim 3, wherein an end of the screw opposite the head abuts the positioning wall and rotation of the head of the screw moves the trestle vertically and horizontally with respect to the brace.

5. The hinge support of claim 4, wherein the first direction is approximately perpendicular to and away from the surface of the door when the brace is mounted to the surface of the door, and the positioning wall has a height measured in the first direction that is greater than a distance moved by the trestle in the first direction.

6. The hinge support of claim 3, wherein the support wall includes a slot formed in the support wall to support the shaft of the screw.

7. The hinge support of claim 6, wherein the nut support platform is positioned adjacent the support wall.

8. The hinge support of claim 3, further comprising a cap configured for positioning over the nut support platform to hold the nut in the nut support platform.

9. The hinge support of claim 1, wherein the base wall comprises an aperture and the top wall comprises an elongated slot, wherein the elongated slot is positioned over the aperture in the first direction when the trestle is mounted to the brace, and the elongated slot has a length measured in a direction that is perpendicular to the first direction that is greater than a distance moved by the trestle in the direction that is perpendicular to the first direction.

10. The hinge support of claim 9, wherein the base wall comprises a second aperture and the top wall comprises a second elongated slot, wherein the second elongated slot is positioned over the second aperture in the first direction when the trestle is mounted to the brace, and the second elongated slot has a second length measured in the direction that is perpendicular to the first direction that is greater than the distance moved by the trestle in the direction that is perpendicular to the first direction.

11. The hinge support of claim 1, wherein the first side wall has a fifth sloped surface, the second side wall has a sixth sloped surface, the third side wall has a seventh sloped surface and the fourth side wall has an eighth sloped surface, and further wherein at least a portion of the seventh sloped surface is positioned to slide along the fifth sloped surface under control of the positioning device and at least a portion of the eighth sloped surface is positioned to slide along the sixth sloped surface under control of the positioning device.

12. The hinge support of claim 1, wherein the first sloped surface supports and abuts at least a portion of the third sloped surface and the second sloped surface supports and abuts at least a portion of the fourth sloped surface.

13. The hinge support of claim 1, wherein the first direction is opposite the second direction.

14. The hinge support of claim 1, wherein a channel is formed between the first sloped surface and the second sloped surface.

15. The hinge support of claim 1, wherein the first sloped surface and the third sloped surface comprise a plurality of stepped surfaces.

16. A hinge assembly comprising:

a device bracket configured for mounting to a device surface of a device;

a door bracket configured for mounting to a door of the device;

an arm mounted for rotation about a first pin and about a second pin, wherein the first pin is mounted to the device bracket and the second pin is mounted to the door bracket; and a hinge support comprising a brace configured for mounting to a door surface of the door, wherein the brace comprises a base wall, a first side wall, a second side wall, and a positioning wall, wherein the first side wall, the second side wall, and the positioning wall extend from the base wall in a first direction, and further wherein the first side wall has a first sloped surface, and the second side wall has a second sloped surface;

a trestle comprising a top wall, a third side wall, a fourth side wall, and a support wall, wherein the third side wall, the fourth side wall, and the support wall extend from the top wall in a second direction, and further wherein the third side wall has a third sloped surface, and the fourth side wall has a fourth sloped surface; and a positioning device configured for mounting the trestle to the brace, wherein the positioning device is supported by the support wall and positioned to abut the positioning wall when mounting the trestle to the brace, and further wherein at least a portion of the third sloped surface is positioned to slide along the first sloped surface under control of the positioning device and at least a portion of the fourth sloped surface is positioned to slide along the second sloped surface under control of the positioning device to position the top wall of the trestle adjacent the door bracket to support the door bracket relative to the door surface.

17. The hinge assembly of claim 16, further comprising a fastener, wherein the base wall comprises a first aperture, wherein the fastener is inserted through the first aperture and into the door surface to mount the hinge support to the door.

18. The hinge assembly of claim 17, wherein the door bracket comprises a second aperture, wherein the fastener is inserted through the second aperture to mount the door bracket to the door.

19. The hinge assembly of claim 18, wherein the top wall comprises an elongated slot, wherein the elongated slot is positioned between the first aperture and the second aperture and the fastener is inserted through the elongated slot when the trestle is mounted to the brace, and the elongated slot has a length measured in a direction that is perpendicular to the first direction that is greater than a distance moved by the trestle in the direction that is perpendicular to the first direction.

20. A device comprising:

a body;

a door;

a hinge pivotally mounting the door to the body, the hinge comprising a device bracket mounted to a surface of the body;

a door bracket mounted to the door; and an arm mounted for rotation about a first pin and about a second pin, wherein the first pin is mounted to the device bracket and the second pin is mounted to the door bracket; and a hinge support comprising a brace mounted to a door surface of the door, wherein the brace comprises a base wall, a first side wall, a second side wall, and a positioning wall, wherein the first side wall, the second side wall, and the positioning wall extend from the base wall in a first direction, and further wherein the first side wall has a first sloped surface, and the second side wall has a second sloped surface;

a trestle comprising a top wall, a third side wall, a fourth side wall, and a support wall, wherein the third side wall, the fourth side wall, and the support wall extend from the top wall in a second direction, and further wherein the third side wall has a third sloped surface, and the fourth side wall has a fourth sloped surface; and a positioning device mounting the trestle to the brace, wherein the positioning device is supported by the support wall and positioned to abut the positioning wall when mounting the trestle to the brace, and further wherein at least a portion of the third sloped surface is positioned to move along the first sloped surface under control of the positioning device and at least a portion of the fourth sloped surface is positioned to move along the second sloped surface under control of the positioning device to position the trestle adjacent the door bracket to support the door bracket relative to the door surface.

* * * * *